US006056562A

United States Patent [19]

Kobayashi et al.

[11] Patent Number: 6,056,562

[45] **Date of Patent: *May 2, 2000**

[54] WIRE END CONNECTION CONSTRUCTION

[75] Inventors: Yoshinao Kobayashi; Yuji Watanabe, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/073,608

[22] Filed: May 6, 1998

Related U.S. Application Data

[62] Division of application No. 08/758,925, Dec. 2, 1997.

[51] Int. Cl.[7] ..... H01R 13/44

[52] U.S. Cl. ..... 439/125; 439/281

[58] Field of Search ..... 439/125–128, 439/278, 281

[56] References Cited

U.S. PATENT DOCUMENTS

| | | | |
|---|---|---|---|
| 3,076,113 | 1/1963 | Candelise . | |
| 3,335,392 | 8/1967 | Elliott . | |
| 3,842,389 | 10/1974 | Glover et al. . | |
| 3,850,495 | 11/1974 | Glover . | |
| 3,963,295 | 6/1976 | Askman et al. . | |
| 4,090,759 | 5/1978 | Herrmann, Jr. . | |
| 5,026,294 | 6/1991 | Hisatomi et al. | 439/125 |
| 5,267,869 | 12/1993 | Nadasky et al. | 439/125 |

FOREIGN PATENT DOCUMENTS

| | | |
|---|---|---|
| 0 565 465 | 10/1993 | European Pat. Off. . |
| 1 204 018 | 10/1965 | Germany . |

*Primary Examiner*—Gary F. Paumen

*Attorney, Agent, or Firm*—Anthony J. Casella; Gerald E. Hespos

[57] ABSTRACT

A distributor 13 is formed with a tubular receptacle 15, and a male terminal fitting 11 projects in the center of the reptacle 15. A female terminal fitting 12 is connected with an end of a wire 16. Further, a seal member 21 is so mounted as to cover the female terminal fitting 12 and cause it to project: along the center axis. At the seal member 21, a guide portion 24 is so formed as to cover the female terminal fitting 12, and its leading end is tapered to form a guide surface 24*a*. Thus, even if the female terminal fitting 12 is inserted while being displaced from its proper insertion position, the guide surface 24*a* comes into contact with an opening edge 15*a* of the receptacle 15, thereby guiding the fitting 12 to the proper insertion position. As a result, the female terminal fitting 12 can be connected with the male terminal fitting 11.

1 Claim, 10 Drawing Sheets

WIRE END CONNECTION CONSTRUCTION

This application is a divisional of application Ser. No. 08/758,925 filed Dec. 2, 1997.

BACKGROUND OF THE INVENTION

1. Field of the Invention

The present invention relates to a wire end connection construction for the connection of the wire with an apparatus.

2. Description of the Prior Art

The internal combustion engine of a vehicle is provided with a distributor with which a spark coil or the like is connected via a high voltage resistive wire.

A prior art construction for the above connection is as shown in FIG. 21. Specifically, a distributor 1 is formed with a tubular receptacle 2 in the middle of which an externally threaded rod as a male terminal fitting 3 projects. At the end of a high voltage resistive wire, a female terminal fitting 5 is mounted. Further, a tubular seal member 6 is mounted at the end of the high voltage resistive wire such that the female terminal fitting 5 projects in the middle of the hollow space of the seal member 6.

In order to connect the wire 4 with the distributor 1, the female terminal fitting 5 is connected with the male terminal fitting 3 while the seal member 6 is fitted into the receptacle 2.

However, in the above construction, since the seal member made of rubber is easily deformable, the female terminal tends to be slanted or displaced from the center position, making it difficult to connect the female and male terminal fittings. Further, since the opening of the receptacle is sealed by the seal member before the female terminal fitting is connected with the male terminal fitting, the position of the male terminal fitting cannot be confirmed after an intermediate stage, making the connection even more difficult.

In view of the above problems, an object of the present invention is to provide a wire end connection construction which ensures an easier connection.

SUMMARY OF THE INVENTION

According to the invention, there is provided a wire end connection construction in which a terminal fitting is connectable with an end of a wire and is further connectable with a second terminal fitting disposed in a terminal chamber on an apparatus. The wire end connection of the subject invention comprises a seal member at particularly the end of the wire for watertight sealing of the opening of the terminal chamber when both terminal fittings are connected. The seal member is formed with at least one guide portion for guiding the first terminal fitting substantially to a position where it is connectable with the second terminal fitting by coming into contact from a radially inward direction with an inner wall surface of the terminal chamber when the end of the wire is inserted or upon the insertion of the first terminal fitting into the terminal chamber.

According to a preferred embodiment of the invention, the seal member is formed with the guide portion.

Preferably, the terminal chamber has a substantially tubular shape and wherein the seal member and the guide portion have preferably concentric substantially tubular shapes and are substantially disposed along the same center axis as the terminal chamber at least in their connected state. A tubular shape according to the invention might have a substantially circular, elliptic, square or rectangular cross sectional shape.

Further preferably, the guide portion has such a substantially tubular shape that it substantially covers (i.e. it has at least the same longitudinal extension) the first terminal fitting and its outer surface comes into contact with the inner wall surface of the terminal chamber when both terminal fittings are connected or are to be connected, and in particular acts as a seal member for sealing the opening of the terminal chamber, preferably watertight.

Still further preferably, a clearance for permitting the deformation of the guide portion is defined substantially between the guide portion and the first terminal fitting.

Most preferably, the terminal chamber is formed by a substantially tubular wall projecting from the equipment, and preferably wherein the seal member comprises an outer sealing portion which is, in particular watertightly, substantially fitted to or on the outer surface of the tubular wall and/or an inner sealing portion which is, in particular watertightly inserted into the tubular wall, wherein in particular the inner and outer sealing portions are displaced with respect to each other along an insertion direction, in particular of the sealing portions into or on the tubular wall or along a connection direction of the terminal fittings.

According to a further preferred embodiment, the seal member is formed with an insertion hole into which the first terminal fitting connected with the wire is inserted, and/or a retaining portion for engaging the first terminal fitting to retain it in a specified or predetermined or predeterminable position.

According to still a further preferred embodiment of the invention, the guide portion is provided at or on the first terminal fitting, in particular for guiding the first terminal fitting to the position for coupling with or fitting on the second terminal fitting by coming into contact with particularly the opening edge of the terminal chamber upon or during the insertion of the first terminal fitting into the terminal chamber and/or when (in particular the end of) the wire is inserted into the terminal chamber.

Preferably, the first terminal fitting comprises a securing portion with which the wire is to be connected and/or a connection portion with which the second terminal fitting is to be connected, and preferably wherein the guide portion is formed between the securing portion and the connection portion.

Further preferably, the guide portion is formed into a preferably hollow substantially cylindrical shape.

Still further preferably, the guide portion is integrally or unitarily formed with the first terminal fitting, in particular by bending.

Most preferably, one or more projections are formed on the guide portion, the two or more projections being preferably equally spaced in the circumferential direction.

According to the invention, there is further provided a wire end connection construction, in particular according to the invention as described above or according to one or more of the preceding embodiments, in which a first terminal fitting is connected or connectable with (in particular an end of) a wire and is connectable with a second terminal fitting being disposed in a terminal chamber provided or formed at or on an equipment, comprising a seal member provided or provideable at the wire, in particular for sealing the opening of the terminal chamber particularly watertight, when both terminal fittings are connected, and having one or more seal portions or guide portion extending substantially in parallel to the first terminal fitting, wherein at least one seal portion is arranged in the radial direction between the first terminal fitting and the terminal chamber, the seal portion extending in particular substantially along the full or complete longitudinal extension or length of the first terminal fitting.

Thus, according to the invention, the sealing properties of the wire end connector are improved, in particular against the infiltration of moisture. Furthermore the sealing portion can serve also as a guide portion for substantially guiding the first fitting to a coupling position with the second fitting, thus providing according to the invention a double function of improved sealing and of improved connectability.

According to a preferred embodiment of the invention, there is provided a wire end connection construction in which one of terminal fittings connectable with each other is connected with an end of a wire and the other terminal fitting is disposed in a terminal chamber formed at an equipment, the one terminal fitting is connected with the other terminal fitting by inserting the end of the wire into the terminal chamber through an opening of the terminal chamber, comprising:

a seal member provided at the end of the wire for sealing the opening of the terminal chamber watertight when both terminal fittings are connected, the seal member being formed with a guide portion for guiding the one terminal fitting to a position where it is connectable with the other terminal fitting by coming into contact with the opening edge of the terminal chamber when the end of the wire is inserted into the terminal chamber.

Accordingly, the end of the wire is connected with the equipment by inserting the end of the wire into the terminal chamber formed at the equipment and connecting the one terminal fitting with the other terminal fitting. At this time, if the one terminal fitting is inserted while being displaced from its proper insertion position, the guide portion comes into contact with the opening edge of the terminal chamber, thereby guiding the one terminal fitting to the proper insertion position. In other words, the one terminal fitting can be securely connected with the other terminal fitting by being guided to the proper insertion position. Simultaneously, the opening of the terminal chamber is sealed by the seal member.

Accordingly, by forming the guide portion at the seal member, even if the one terminal fitting is displaced from its proper insertion position, it can be guided to and connected with the other terminal fitting. Therefore, the terminal fittings can be easily and securely connected.

Preferably, the terminal chamber has a tubular shape, and the seal member and the guide portion have concentric tubular shapes and are disposed along the same center axis as the terminal chamber.

Accordingly, if the one terminal fitting is displaced from its proper insertion position when both terminal fittings are connected, the guide portion and the seal member are displaced from the center axis of the terminal chamber, with the result that the guide portion comes into contact with the opening edge of the terminal chamber. Accordingly, while being inserted, the one terminal fitting is gradually guided to its proper insertion position, and the terminal fittings are securely connected. Simultaneously, the opening of the terminal chamber is sealed by the seal member.

Further preferably, the guide portion has such a tubular shape that it covers the one terminal fitting and its outer surface comes into contact with the inner wall surface of the terminal chamber when both terminal fittings are connected, and acts as a seal member for sealing the opening of the terminal chamber watertight.

Accordingly, the guide portion guides the one terminal fitting to its proper insertion position when the terminal fittings are connected, and seals the opening of the terminal chamber watertight after the terminal fittings are connected by coming into contact with the inner wall surface of the terminal chamber. Since the guide portion has a sealing function as well as a guiding function, it is not necessary to separately form the seal member. As a result, the construction of the guide portion can be simplified.

Still further preferably, a clearance for permitting the deformation of the guide portion is defined between the guide portion and the one terminal fitting.

Accordingly, the guide portion which also acts as the seal member is deformed when coming into contact with the inner wall surface of the terminal chamber. Accordingly, an insertion force can be reduced, making the insertion of the guide portion into the terminal chamber easier. As a result, the terminal fittings can be easily connected while the terminal chamber is securely sealed.

Still further preferably, the terminal chamber is formed by a tubular wall projecting from the equipment, and the seal member comprises an outer sealing portion which is watertightly fitted to the outer surface of the tubular wall and an inner sealing portion which is watertightly inserted into the tubular wall.

Accordingly, when the terminal fittings are connected, the outer sealing portion is, in particular watertightly fitted to the outer surface of the tubular wall while the inner sealing is watertightly inserted into the tubular wall. Since the terminal chamber is sealed by both inner and outer sealing portions, a sealing performance can be enhanced.

Most preferably, the inner and outer sealing portions are displaced with respect to an insertion direction.

Accordingly, since the inner and outer sealing portions are displaced with respect to the insertion direction, they are pressed against the tubular wall not simultaneously, but with a delay when the terminal fittings are connected. Accordingly, an insertion resistance can be reduced. Further, since the terminal chamber is sealed by both inner and outer sealing portions, a sealing performance can be enhanced.

According to a further preferred embodiment, the seal member is formed with an insertion hole into which the one terminal fitting connected with the end of the wire is inserted, and a retaining portion for engaging the one terminal fitting to retain it in a specified position.

Accordingly, the one terminal fitting can be retained by the retaining portion of the seal member. Accordingly, the one terminal fitting does not wobble when the terminal fittings are connected, thereby making the connection of the terminal fittings easier.

According to still a further preferred embodiment of the invention, there is provided a wire end connection construction in which one of terminal fittings connectable with each other is connected with an end of a wire and the other terminal fitting is disposed in a terminal chamber formed at an equipment, the one terminal fitting is connected with the other terminal fitting by inserting the end of the wire into the terminal chamber through an opening of the terminal chamber, comprising:

a seal member for sealing the opening of the terminal chamber watertight when both terminal fittings are connected, and a guide portion provided at the one terminal fitting for guiding the one terminal fitting to the position of the other terminal fitting by coming into contact with the opening edge of the terminal chamber when the end of the wire is inserted into the terminal chamber.

Accordingly, the end of the wire is connected with the equipment by inserting the end of the wire into the terminal chamber formed at the equipment and connecting the one terminal fitting with the other terminal fitting. At this time, if the one terminal fitting is inserted while being displaced from its proper insertion position, the guide portion comes into contact with the opening edge of the terminal chamber, thereby guiding the one terminal fitting to the proper insertion position. In other words, the one terminal fitting can be securely connected with the other terminal fitting by being guided to the proper insertion position. Simultaneously, the opening of the terminal chamber is sealed by the seal member.

As described above, since the guide portion is formed at the one terminal fitting, the one terminal fitting can be guided to and connected with the other terminal fitting even if it is displaced from its proper insertion position. Therefore, the fittings can be easily and securely connected.

Preferably, the one terminal fitting comprises a securing portion with which the end of the wire is to be connected and a connection portion with which the other terminal fitting is to be connected, and the guide portion is formed between the securing portion and the connection portion.

Further preferably, the guide portion is formed into a hollow cylindrical shape.

Still further preferably, the guide portion is integrally or unitarily formed with the one terminal fitting by bending.

Most preferably, a projection is formed on the guide portion.

Accordingly, when the one terminal fitting is displaced from its proper insertion position, the guide portion and the projection come into contact with the opening edge of the terminal chamber, thereby guiding the one terminal fitting to the proper insertion position.

Accordingly, the one terminal fitting can be guided over a wider range by forming the projection on the guide portion. Thus, the fittings can be securely connected by guiding the displaced one terminal fitting to its proper insertion position even in the case that the diameter of the one terminal fitting is smaller than the inner diameter of the terminal chamber.

These and other objects, features and advantages of the present invention will become more apparent upon a reading of the following detailed description and accompanying drawings.

DETAILED DESCRIPTION OF THE PREFERRED EMBODIMENTS

Figure 2:
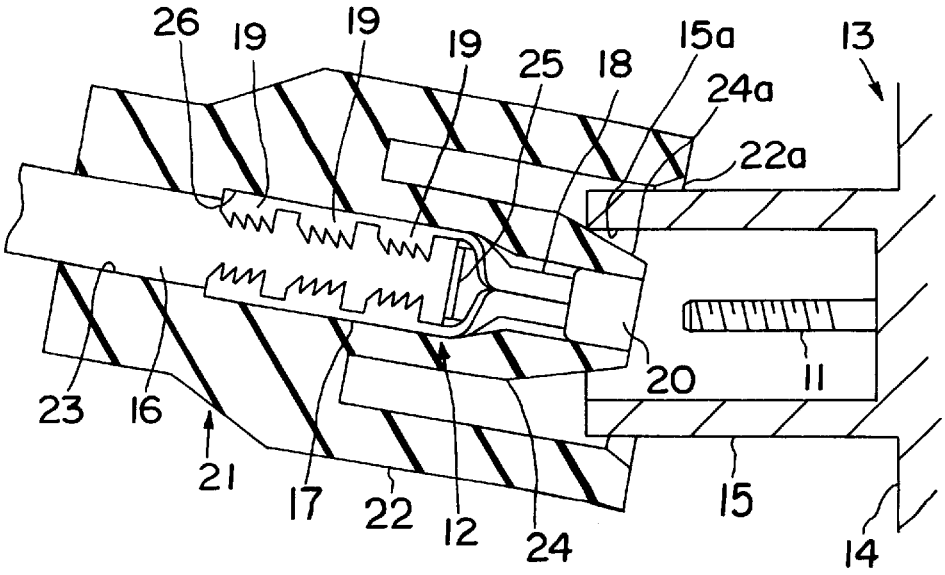
FIG. 2 is a section showing a state where a guide surface is in contact with a receptacle in the first embodiment.
Figure 3:
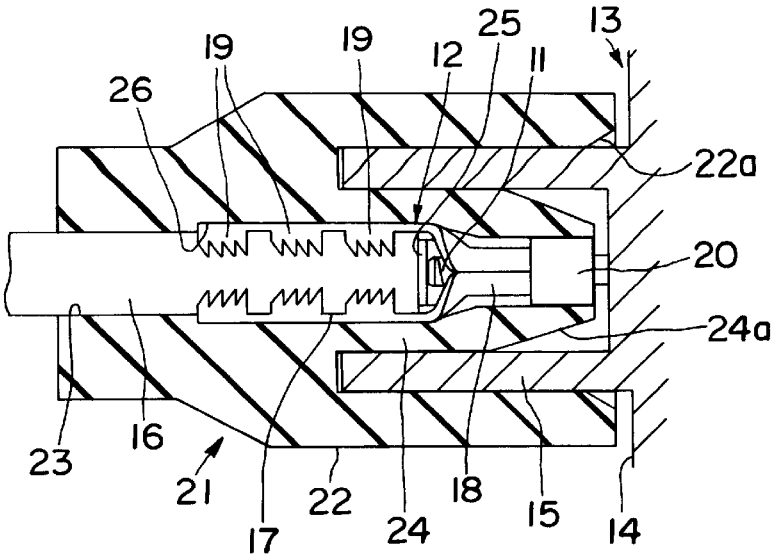
FIG. 3 is a section showing a state where female and male terminal fittings are connected in the first embodiment.

Hereafter, a first embodiment of the wire end connection construction according to the invention is described with reference to FIGS. 1 to 3.

This wire end connection construction is adapted to connect an end of a high voltage resistive wire with e.g. a distributor or a spark coil in the internal combustion engine of a vehicle.

Figure 1:
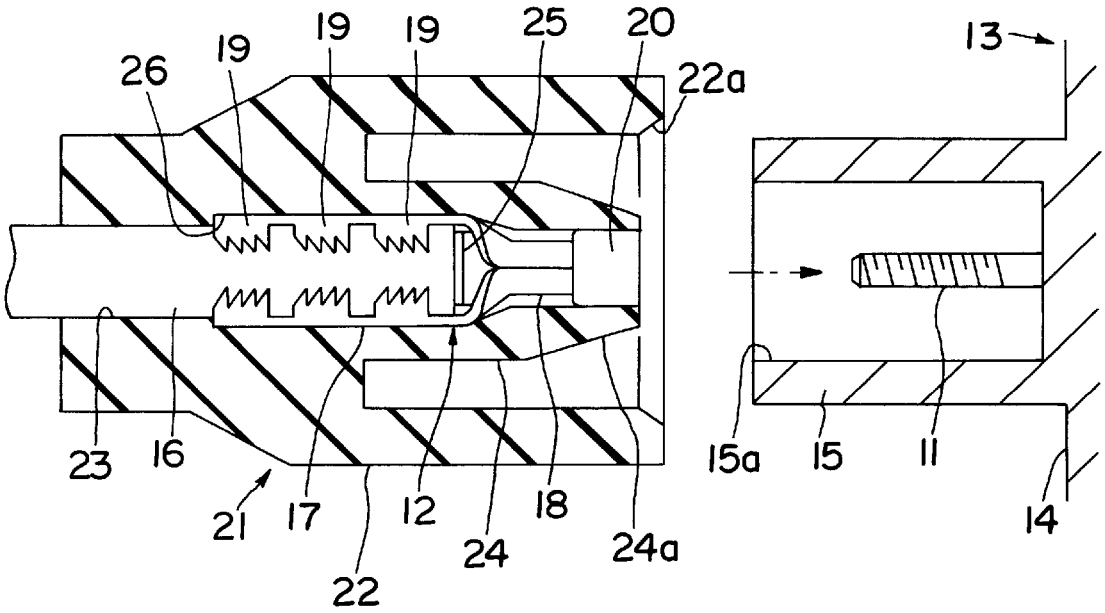
FIG. 1 is a section of a first embodiment.

As shown in FIG. 1, this connection construction is provided with a male terminal fitting 11 and a female terminal fitting 12 which are connectable with each other. The male terminal fitting 11 is disposed in a receptacle 15 projecting from a side surface of a casing 14 of a distributor 13. The receptacle 15 has a tubular shape, and the inner diameter thereof is considerably larger than the diameter of the male terminal fitting 11. The male terminal fitting 11 is an externally threaded rod, and projects along a center axis of the receptacle 15 by such a distance that the leading end thereof is located slightly inward of an opening edge 15*a* of the receptacle 15. Through unillustrated, the male terminal fitting 11 is connected with a distribution circuit within the distributor 13.

On the other hand, the female terminal fitting 12 is connected with an end of a wire 16. The female terminal fitting 12 includes a barrel portion 17 and a connection portion 18 formed at the leading end of the barrel portion 17 and engageable with the male terminal fitting 11. The barrel portion 17 includes one or more, in particular three pairs of deformable portions 19 along its longitudinal direction. After the end of the wire 16 is placed on the barrel portion 17, the deformable portions 19 are bent to retain the wire 16, thereby connecting the end of the wire 16 with the barrel 17. The leading end of each deformable portion 19 is serrated like saw teeth, so that it cuts in the insulation coating of the wire 16 when being bent, thereby making the connection more secure. The connection portion 18 is formed by bending a metal strip into a hollow cylindrical shape extending along the longitudinal direction, and the inner diameter thereof is substantially equal to the outer diameter of the male terminal fitting 11. A C-shaped elastic member 20 is fitted on the leading end of the connection portion 18 to join a seam formed when the metal strip is bent. The elastic member 20 applies a biasing force to narrow the opening of the connection portion 18, and the male terminal fitting 11. is pressed into the narrowed opening of the connection portion 18. Between the barrel portion 17 and the connection portion 18, a stopper wall 25 is formed by bending the material. When the wire 16 is connected, the leading end thereof comes into contact with the stopper wall 25 to be positioned.

A seal member 21 of insulating and/or sealing material, e.g. of rubber is mounted on the end of the wire 16. At the front side of the seal member 21, there is formed a sealing tubular portion 22 fittable to the outer surface of the receptacle 15. The sealing tubular portion 22 has an inner diameter slightly smaller than the outer diameter of the receptacle 15, and is watertightly fittable to the receptacle 15. A through hole 23 is so formed as to extend from the rear end surface of the seal member 21 to the inside of the sealing tubular portion 22. The rear part of the through hole 23 has a diameter slightly smaller than the that of the wire 16, and the front part thereof is formed to have a slightly larger diameter (slightly smaller than the barrel portion 17) than that of the rear part, thereby forming a retaining portion 26. The barrel portion 17 of the female terminal fitting 12 connected with the wire 16 is fitted into the retaining portion 26 through the through hole 23, with the result that the female terminal fitting 12 is retained with the connection portion 18 projecting into the sealing tubular portion 22.

Inside the sealing tubular portion 22, a guide portion 24 projects such that it coats the outer surface of the female terminal fitting 12. The guide portion 22 has a tubular shape, and the outer diameter thereof is slightly smaller than the inner diameter of the receptacle 15. The leading end of the guide portion 24 is tapered to form a guide surface 24*a*. More specifically, when the female terminal fitting 12 is inserted into the receptacle 15 while being displaced from its proper insertion position (center axis of the receptacle 15), the guide surface 24*a* comes into contact with the opening edge 15*a* of the receptacle 15, thereby guiding the female terminal fitting 12 to the proper insertion position. An opening edge 22*a* of the tubular portion 22 is also tapered to make it easier to fit the tubular portion 22 on the receptacle 15.

Next, the action of this embodiment is described. In order to connect the end of the wire 16 with the distributor 13, the female terminal fitting 12 is inserted into the receptacle 15 while the seal member 21 is fitted on the receptacle 15. At this time, if the female terminal fitting 12 is obliquely inserted while being displaced from its proper insertion position as shown in FIG. 2, the guide surface 24*a* of the guide portion 24 comes into contact with the opening edge 15*a* of the receptacle 15. Accordingly, while being pressed into the receptacle 15, the female terminal fitting 12 is guided to its proper insertion position, and consequently connected with the male terminal fitting 11. As a result, the terminal fittings 11, 12 are securely connected, and the opening of the receptacle 15 is sealed watertight (see FIG. 3).

Since the seal member 21 is formed with the guide portion 24 in this embodiment, the terminal fittings 11, 12 can be securely connected even if the female terminal fitting 12 is obliquely inserted while being displaced from its proper insertion position. In other words, since the terminal fittings 11, 12 can be securely connected only by inserting the female terminal fitting 12 into the receptacle 15, the connection can be very easily made. Further, since the female terminal fitting 12 can be retained by the retaining portion 26 of the seal member 21, the female terminal fitting 12 does not wobble when the terminal fittings 11, 12 are connected. As a result, the connection can be more easily made.

A second embodiment of the wire end connection construction according to the invention is described with reference to FIG. 4.

Although the guide portion 24 of the first embodiment has its leading end tapered, a guide portion of the second embodiment has a tapered projected portion formed at its leading end.

Figure 4:
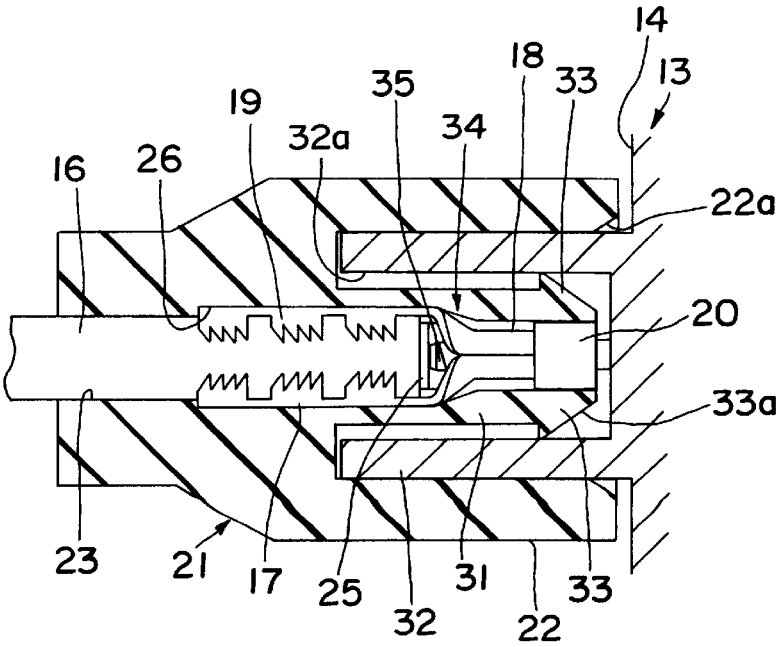
FIG. 4 is a section of a second embodiment.

Specifically, as shown in FIG. 4, a guide portion 31 is formed such that its outer diameter is slightly smaller than the inner diameter of a receptacle 32, a front part of its outer surface projects more outward than a base part, and this projected portion 33 is tapered toward the leading end of the guide portion 31. The outer diameter of the projected portion 33 is slightly larger than the inner diameter of the receptacle 32 so that, when the guide portion 31 is inserted into the receptacle 32, the projected portion 33 is compressed to be in close contact with the inner wall surface of the receptacle 32. Where the projected portion 32 is tapered, there is formed a guide surface 33*a*. When a female terminal fitting 34 is displaced from its proper insertion position, the guide surface 33*a* comes into contact with an opening edge 32*a* of the receptacle 32, thereby guiding the female terminal fitting 34 to the proper insertion position. Since the other construction is similar or same as that of the first embodiment, no description is given by identifying the corresponding or same elements by the same reference numerals.

Thus, even if the female terminal fitting 34 is inserted while being displaced from its proper insertion position, it is guided to the proper insertion position by the guide surface 33*a*. Accordingly, the terminal fittings 34, 35 can be easily and securely connected as in the first embodiment. Further, as the terminal fittings 34, 35 are connected, the opening of the receptacle 32 is sealed watertight by both the sealing tubular portion 22 and the projected portion 33, further enhancing a sealing performance.

A third embodiment of the wire end connection construction according to the invention is described with reference to FIG. 5.

Figure 5:
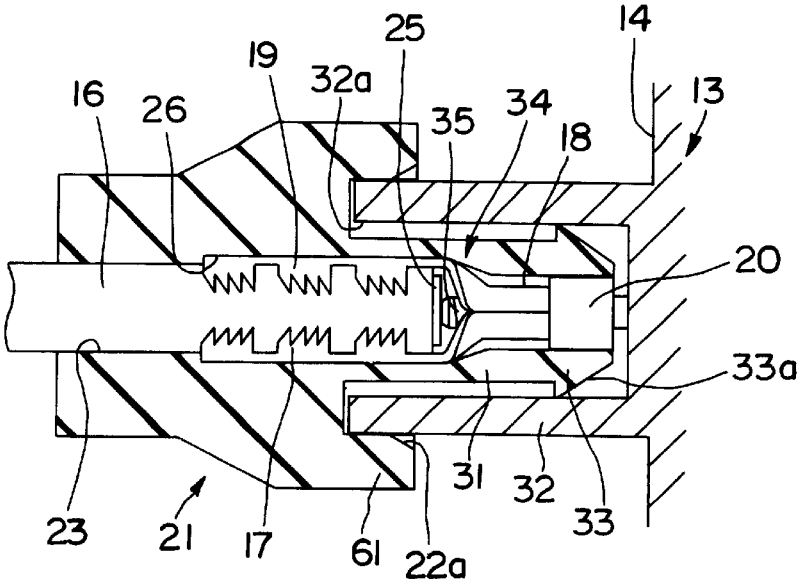
FIG. 5 is a section of a third embodiment.

Although the depth of the sealing tubular portion 22 is set substantially equal to the projecting distance of the receptacle 32 in the second embodiment, a sealing tubular portion 61 has a short depth as shown in FIG. 5 and can cover only the leading end of the receptacle 32 in this embodiment. Since the other construction is similar or same as that of the second embodiment, no description is given by identifying the corresponding or same elements by the same reference numerals.

In such a case, when the terminal fittings 34, 35 are connected, the projected portion 33 is inserted into the receptacle 32 while being compressed and then the sealing tubular portion 61 is fitted to the outer surface of the receptacle 32. Accordingly, the projected portion 33 and the sealing tubular portion 61 are not simultaneously pressed against the receptacle 32, thereby reducing an insertion resistance. Further; since the opening of the receptacle 32 can be sealed by both the sealing tubular portion 61 and the projected portion 33, a sealing performance can be further enhanced.

A fourth embodiment of the wire end connection construction according to the invention is described with reference to FIGS. 6 and 7.

Figure 6:
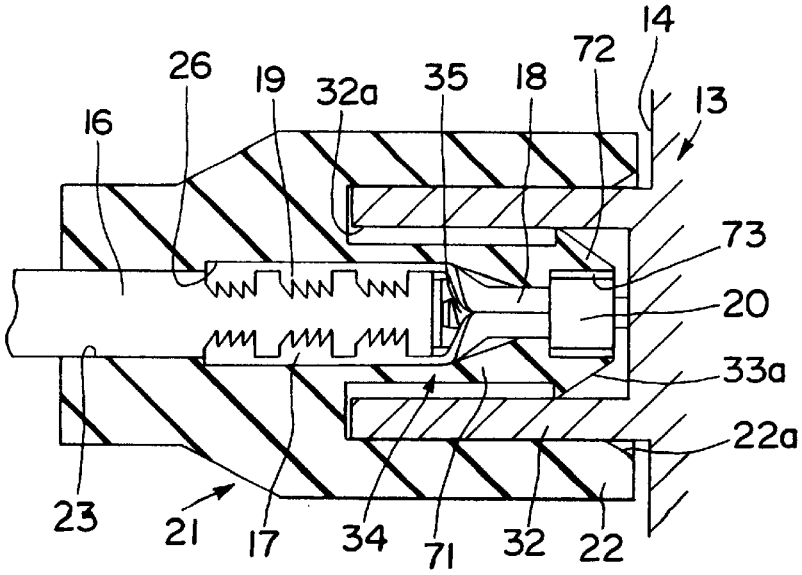
FIG. 6 is a section of a fourth embodiment.
Figure 7:
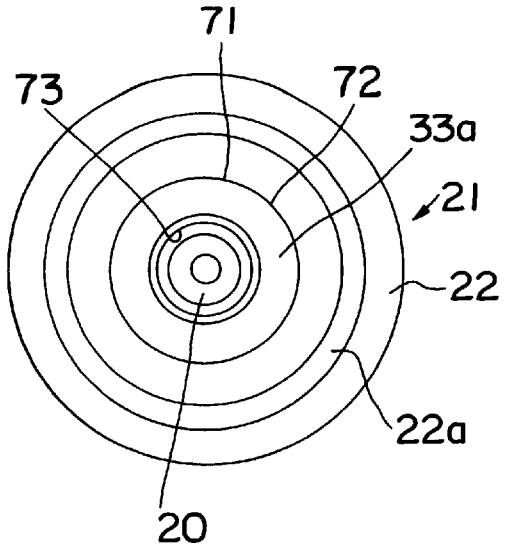
FIG. 7 is a front view of a fourth embodiment.

Although the elastic member 20 fitted on the female terminal fitting 34 is in close contact with the inner surface of the projected portion 33 in the second embodiment, the inner surface of a projected portion 72 formed at the leading end of a guide portion 71 is cut away over the entire circumference to form a clearance 73 between the inner surface of the projected portion 72 and the elastic member 20 as shown in FIGS. 6 and 7 in this embodiment. Since the other construction is similar to or the same as that of the second embodiment, no description is given by identifying the corresponding or same elements by the same reference numerals.

Thus, the projected portion 72 is deformed if it comes into contact with the opening edge 32*a* of the receptacle 32 when the terminal fittings 34, 35 are connected, and inserted into the receptacle 32 while guiding the female terminal fitting 34 to its proper insertion position. Accordingly, a force for inserting the guide portion 71 into the receptacle 32 can be reduced, with the result that the terminal fittings 34, 35 can be easily connected and the opening of the receptacle 32 can be easily sealed.

A fifth embodiment of the wire end connection construction according to the invention is described with reference to FIG. 8.

Figure 8:
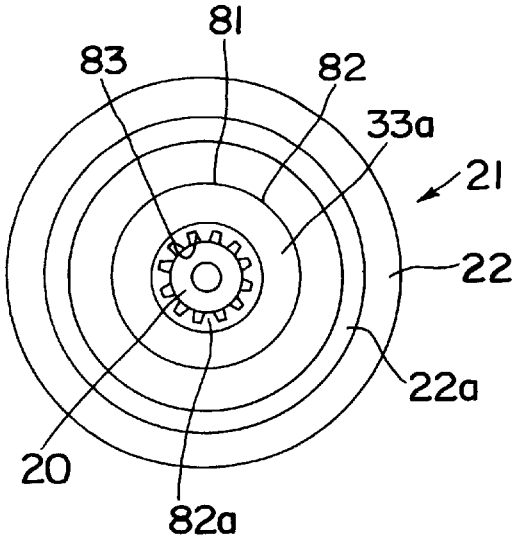
FIG. 8 is a front view of a fifth embodiment.

Although the elastic member 20 fitted on the female terminal fitting 34 is in close contact with the inner surface of the projected portion 33 in the second embodiment, the inner surface of a projected portion 82 formed at the leading end of a guide portion 81 is serrated over the entire circumference to form a clearance 83 between the inner surface of the projected portion 82 and the elastic member 20 as shown in FIG. 8 in this embodiment. The clearance 83 is interrupted in the circular direction by projections 82*a*, which extend inwardly from the projected portion, being in particular unitarily or integrally formed therewith, toward the C-shaped elastic member 20, thus forming a star-like configuration. Since the other construction is similar or same as that of the second embodiment, no description is given by identifying the corresponding or same elements by the same reference numerals.

Thus, the projected portion 82 is deformed if it comes into contact with the opening edge 32*a* of the receptacle 32 when the terminal fittings 34, 35 are connected, and inserted into the receptacle 32 while guiding the female terminal fitting 34 to its proper insertion position. Accordingly, similar to the fourth embodiment, a force for inserting the guide portion 81 into the receptacle 32 can be reduced. Further, since the inner surface is serrated, the opening of the receptacle 32 can be sealed while preventing the strain caused by the compression of the projected portion 82.

A sixth embodiment of the wire end connection construction according to the invention is described with reference to FIG. 9.

Although the guide portion 24 of the first embodiment has its leading end tapered, a guide portion 41 of the sixth embodiment has a bulging portion 42 formed at its leading end.

Figure 9:
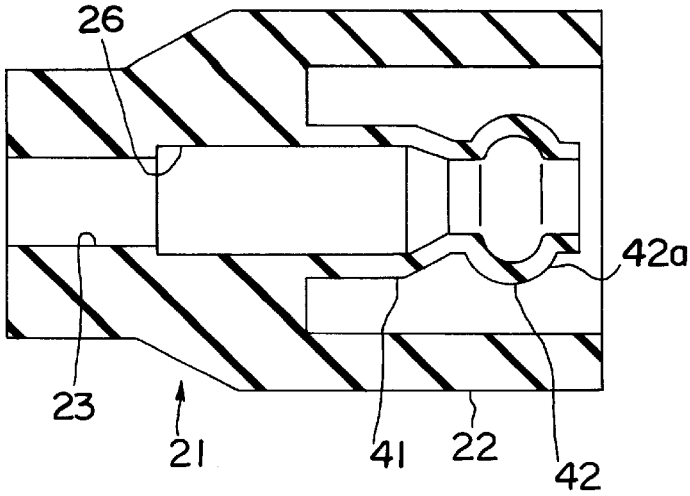
FIG. 9 is a section of a sixth embodiment.

Specifically, as shown in FIG. 9, a guide portion 41 is formed such that its diameter is slightly smaller than the inner diameter of the receptacle and a leading part of its outer surface bulges outward over the entire circumference. This bulging portion 42 has a round or elliptical or rounded annular shape, and the outer diameter of the most bulging part is slightly larger than the inner diameter of the receptacle. In other words, when the guide portion 41 is inserted into the receptacle, the bulging portion 42 is compressed, thereby being brought into close contact with the inner surface of the receptacle. Further, a slanting surface at the front side of the bulging portion 42 forms a guide surface 42*a*. when the female terminal fitting is displaced from its proper insertion position, the guide surface 42*a* comes into contact with the opening edge of the receptacle, thereby guiding the female terminal fitting to the proper insertion position. Since the other construction is similar or same as that of the first embodiment, no description is given by identifying the corresponding or same elements by the same reference numerals.

Thus, similar to the first embodiment, the terminal fittings can be easily and securely connected. Further, since the opening of the receptacle can be sealed watertight by the bulging portion 42 as well, a sealing performance can be further enhanced.

A seventh embodiment of the wire end connection construction according to the invention is described with reference to FIG. 10.

Although the guide portion 24 of the first embodiment has a tapered leading end, a guide portion 51 of the seventh embodiment is formed with lips 52.

Figure 10:
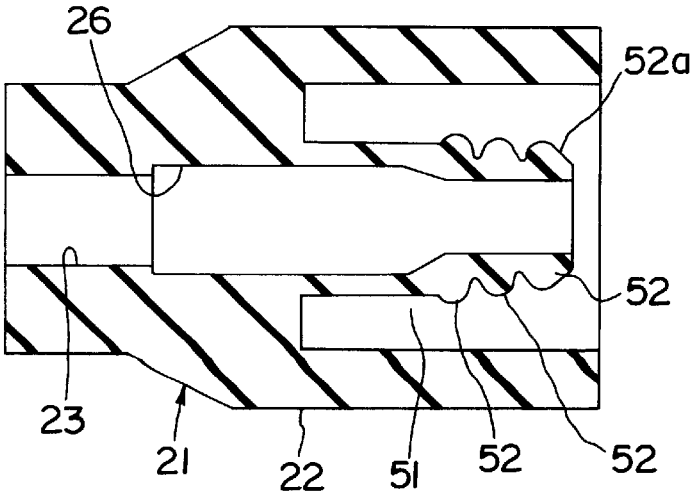
FIG. 10 is a section of a seventh embodiment.

Specifically, as shown in FIG. 10, a guide portion 51 is formed such that its diameter is slightly smaller than the inner diameter of the receptacle, and one or more, in particular three lips 52 are formed one after another along the longitudinal direction at the substantially front part of the outer surface of the guide portion 51. The outer diameter of the lips 52 is slightly larger than the inner diameter of the receptacle. The foremost lip 52 is tapered toward the leading end of the guide portion 51, thereby forming a guide surface 52*a*. Thus, when the guide portion 51 is inserted into the receptacle, the lips 52 are compressed to be in close contact with the inner wall surface of the receptacle. When the female terminal fitting is displaced from its proper insertion position, the guide surface 52*a* comes into contact with an opening edge of the receptacle, thereby guiding the female terminal fitting to the proper insertion position. Since the other construction is similar to or the same as that of the first embodiment, no description is given by identifying the corresponding or same elements by the same reference numerals.

Accordingly, similar to the foregoing embodiments, the terminal fittings can be easily and securely connected. Further, since the opening of the receptacle can be sealed watertight by the lips 52 as well, a sealing performance can be further enhanced.

The present invention is not limited to the foregoing embodiments, but may be embodied in the following manners. These embodiments are also embraced by the technical scope of the present invention as defined in the claims.

(1) Although the sealing tubular portion 61 has such a depth that it can cover only the leading end of the receptacle 32 in the third embodiment, it may be completely deleted. More specifically, in FIG. 5, the sealing tubular portion 61 may not be formed and the opening of the receptacle 32 may be sealed only by the projected portion 33, and the displaced female terminal fitting 34 may be guided to its proper insertion position by the guide surface 33*a* formed at the projected portion 33. The construction can be simplified by deleting the sealing tubular portion 61.

(2) Although the barrel portion 17 includes three pairs of deformable members 19 in the foregoing embodiments, it may include one, two or more than three pairs of deformable members 19. Further, the leading end of each deformable member 19 may not be serrated.

A variety of other changes are possible without departing the scope and spirit of the present invention as defined in the claims.

Figure 12:
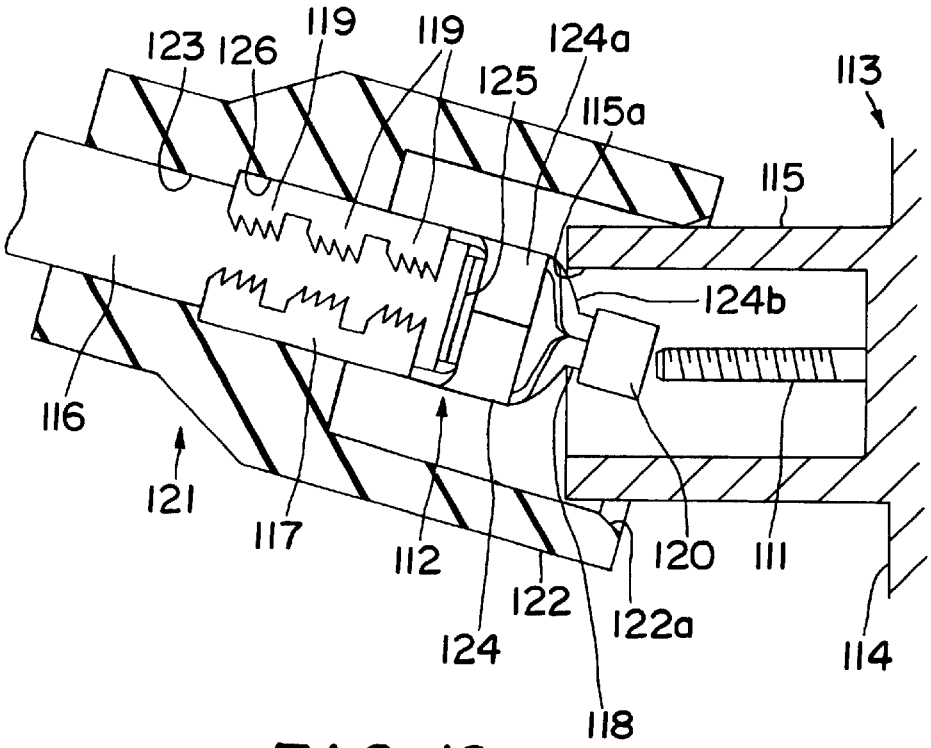
FIG. 12 is a section showing a state where a guide surface is in contact with a receptacle in the eighth embodiment.
Figure 13:
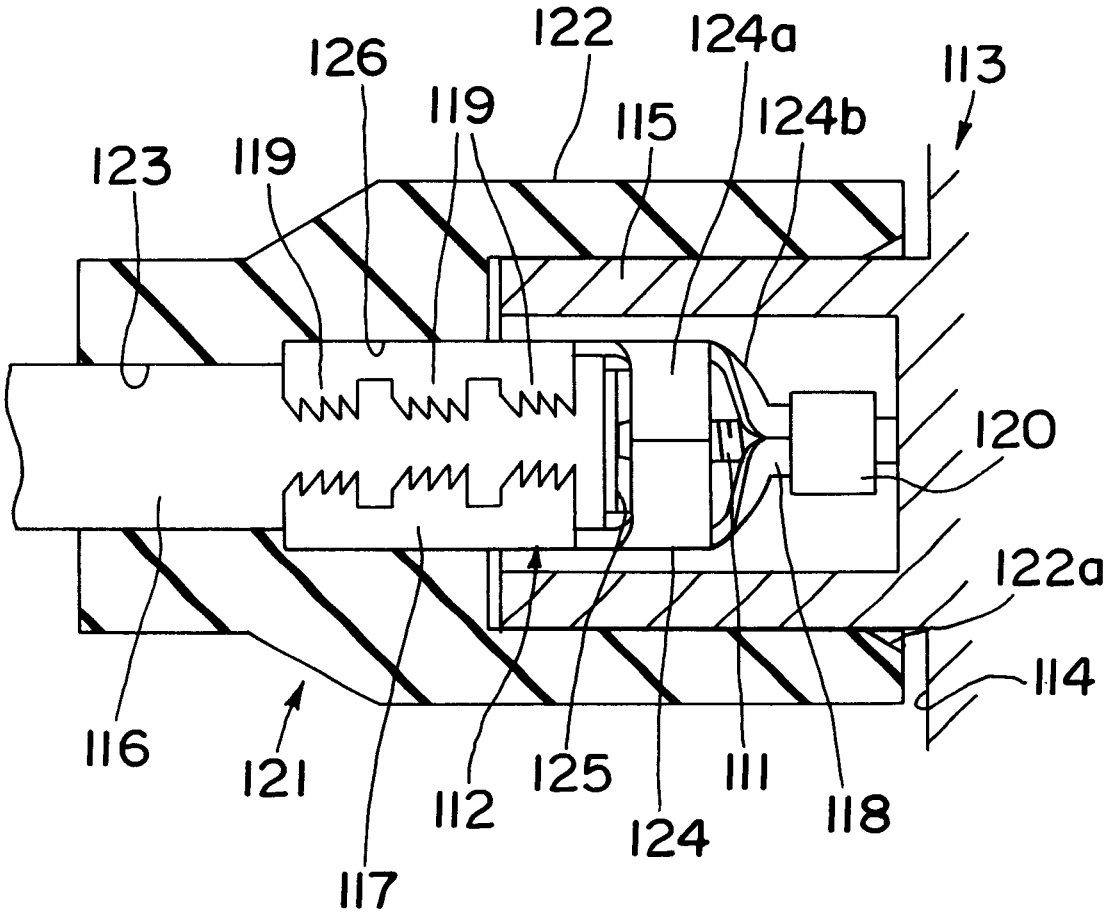
FIG. 13 is a section showing a state where female and male terminal fittings are connected in the eighth embodiment.

An eighth embodiment of the wire end connection construction according to the invention is described with reference to FIGS. 11 to 13.

This wire end connection construction is adapted to connect an end of a high voltage resistive wire with a distributor or a spark coil in the internal combustion engine of a vehicle.

Figure 11:
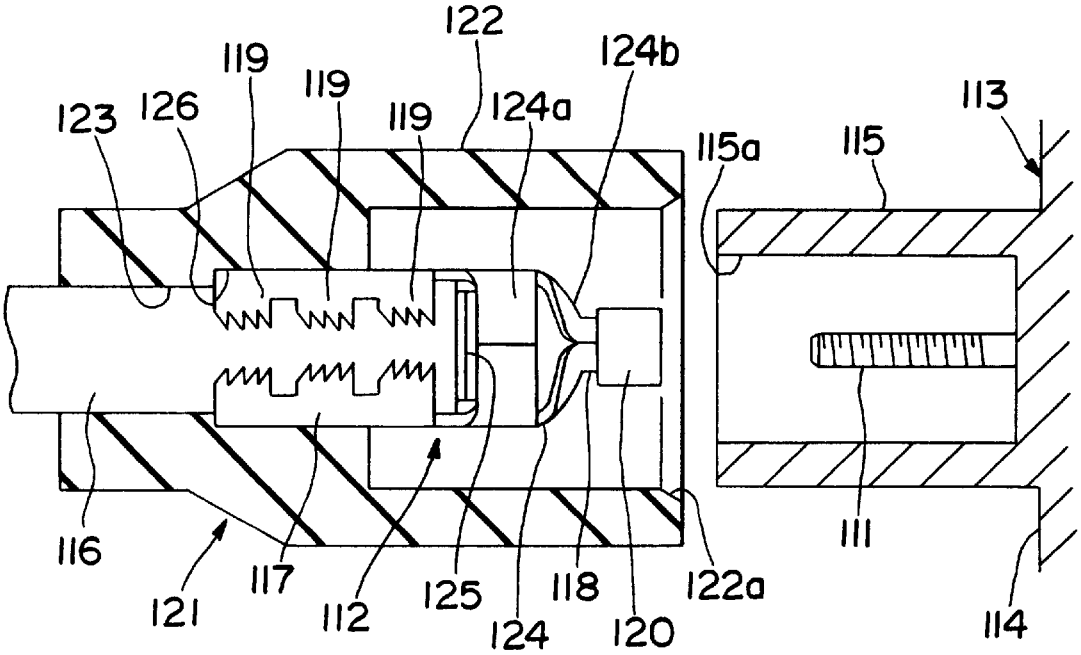
FIG. 11 is a section of an eighth embodiment.

As shown in FIG. 11, this connection construction is provided with a male terminal fitting 111 and a female terminal fitting 112 which are connectable with each other. The male terminal fitting 111 is disposed in a receptacle 115 (corresponding to the terminal chamber according to the invention) projecting from a side surface of a casing 114 of a distributor 113. The receptacle 115 has a tubular shape, and the inner diameter thereof is considerably larger than the diameter of the male terminal fitting 111. The male terminal fitting 111 is an externally threaded rod, and projects along a center axis of the receptacle 115 by such a distance that the leading end thereof is located slightly inward of an opening edge 115*a* of the receptacle 115. Through unillustrated, the male terminal fitting 111 is connected with a distribution circuit within the distributor 113.

On the other hand, the female terminal fitting 112 is connected with an end of a wire 116. The female terminal fitting 112 includes a barrel portion 117 (corresponding to a securing portion according to the invention), a connection portion 118 engageable with the male terminal fitting 111, and a guide portion 24 formed between the barrel portion 117 and the connection portion 118. The barrel portion 117 includes one or more, in particular three pairs of deformable portions 119 along its longitudinal direction. After the end of the wire 116 is placed on the barrel portion 117, the deformable portions 119 are bent to retain the wire 116, thereby connecting the end of the wire 116 with the barrel 117. The leading end of each deformable portion 119 is serrated like saw teeth, so that it cuts in the insulation coating of the wire 116 when being bent, thereby making the connection more secure.

The guide portion 124 is formed by bending a thin metal plate into a hollow cylindrical shape together with the connection portion 118, and its leading end is tapered toward the connection portion 118. The cylindrically formed portion is a guiding cylindrical portion 124*a*, and the outer diameter thereof is set slightly smaller than the inner diameter of the receptacle 115. The outer surface of the tapered portion forms a guide surface 124*b*. When the female terminal fitting 112 is inserted into the receptacle 115 while being displaced from its proper insertion position (the center axis of the receptacle 115), this guide surface 124*b* comes into contact with an opening edge 115*a* of the receptacle 115, thereby guiding the female terminal fitting 112 to the proper insertion position.

The connection portion 118 is formed into a hollow cylindrical shape, and the inner diameter thereof is substantially equal to the outer diameter of the male terminal fitting 111. A C-shaped elastic member 120 is fitted on the leading end of the connection portion 118 to join a seam formed when the metal strip is bent. The elastic member 120 applies a biasing to narrow the opening of the connection portion 118, and the male terminal fitting 111 is pressed into the narrowed opening of the connection portion 118. Between the barrel portion 117 and the connection portion 118, a stopper wall 125 is formed by bending the material. When the wire 116 is connected, the leading end thereof comes into contact with the stopper wall 125 to be positioned.

A seal member 121 of rubber is mounted on the end of the wire 116. At the front side of the seal member 121, there is formed a sealing tubular portion 122 fittable to the outer surface of the receptacle 115. The sealing tubular portion 122 has an inner diameter slightly smaller than the outer diameter of the receptacle 115, and is watertightly fittable to the receptacle 115. A through hole 123 is so formed as to extend from the rear end surface of the seal member 121 to the inside of the sealing tubular portion 122. The rear part of the through hole 123 has a diameter slightly smaller than the that of the wire 116, and the front part thereof is formed to have a slightly larger diameter (slightly smaller than the barrel portion 117) than that of the rear part, thereby forming a retaining portion 126. The barrel portion 117 of the female terminal fitting 112 connected with the wire 116 is fitted into the retaining portion 126 through the through hole 123, with the result that the female terminal fitting 112 is retained with the connection portion 118 projecting into the sealing tubular portion 122. An opening edge 122*a* of the sealing tubular portion 122 is tapered so as to make it easier to fit the sealing tubular portion 122 to the outer surface of the receptacle 115.

Next, the action of this embodiment is described. In order to connect the end of the wire 116 with the distributor 113, the female terminal fitting 112 is inserted into the receptacle 115 while the seal member 121 is fitted on the receptacle 115. At this time, if the female terminal fitting 112 is obliquely inserted while being displaced from its proper insertion position as shown in FIG. 12, the guide surface 124*a* of the guide portion 124 comes into contact with the opening edge 115*a* of the receptacle 115. Accordingly, while being pressed into the receptacle 115, the female terminal fitting 112 is guided to its proper insertion position, and consequently connected with the male terminal fitting 111. As a result, the terminal fittings 111, 112 are securely connected, and the opening of the receptacle 115 is sealed watertight (see FIG. 13).

Thus in this embodiment, since the guide portion 124 is formed at the female terminal fitting 112, even if the female terminal fitting 112 is obliquely inserted while being displaced from its proper insertion position, the fittings 111, 112 can be securely connected. In other words, only by inserting the female terminal fitting 112 into the receptacle 115, the fittings 111, 112 can be securely connected, largely facilitating the connection.

A ninth embodiment of the wire end connection construction according to the invention is described with reference to FIG. 14.

The ninth embodiment differs from the eighth embodiment in that the guide portion 73 is formed with a rib 74.

Figure 14:
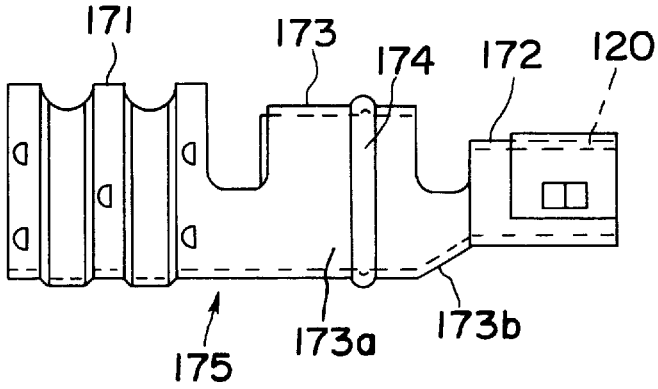
FIG. 14 is a side view of a female terminal fitting according to a ninth embodiment.

Specifically, as shown in FIG. 14, a guide portion 173 is formed between a barrel portion 171 and a connection portion 172 as in the eighth embodiment. At least one rib 174 is formed on the outer surface of a guiding cylindrical portion 173*a* of the guide portion 173 over the entire circumference. The rib 174 is embossed before the guide portion 173 is formed into a hollow cylindrical shape. A projecting distance of the rib 174 is set such that the outer diameter of the guiding cylindrical portion 173 where the rib 174 is formed is slightly smaller than the inner diameter of the receptacle 115 (see FIG. 11). Since the other construction is same as that of the eighth embodiment, no description is given by identifying the corresponding or same elements by the same reference numerals.

Thus, when a female terminal fitting 175 is obliquely inserted while being displaced from its proper insertion position, a guide surface 173*b* and the rib 174 come into contact with the opening edge 115*a* of the receptacle 115, thereby guiding the fitting 175 to the proper insertion position. Accordingly, similar to the eighth embodiment, the fittings 175, 111 (see FIG. 11) can be easily and securely connected. Particularly in this embodiment, since the female terminal fitting 175 can be guided over a wider range by forming the rib 174 on the guiding cylindrical portion 173*a*, it can be effectively guided to its proper insertion position even if the diameter of the guide portion 173 is smaller than the inner diameter of the receptacle 115.

A tenth embodiment of the wire end connection construction according to the invention is described with reference to FIGS. 15 to 19.

Although the rib 174 is formed on the guiding cylindrical portion 173*a* over the entire circumference in the ninth embodiment, three protuberances 32 are formed on the guiding cylindrical portion 31*a* in the tenth embodiment.

Figure 15:
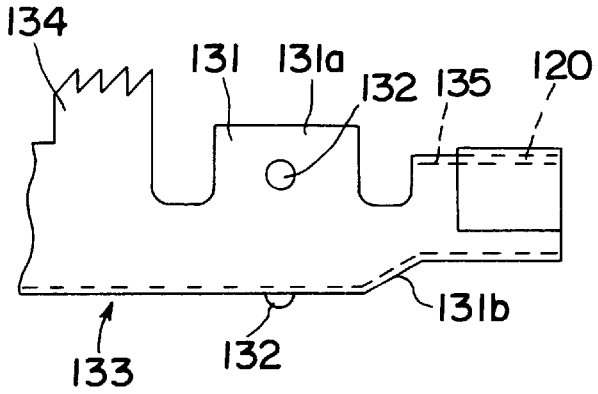
FIG. 15 is a side view of a female terminal fitting according to a tenth embodiment.
Figure 16:
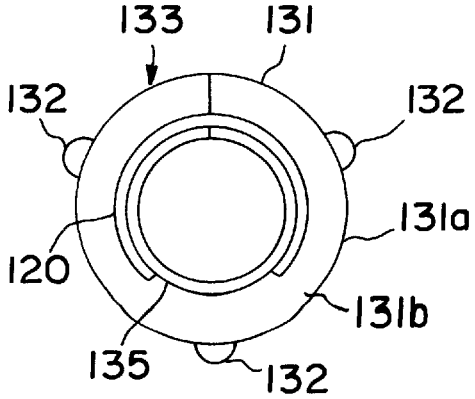
FIG. 16 is a front view of a part of the female terminal fitting according to the tenth embodiment.
Figure 17:
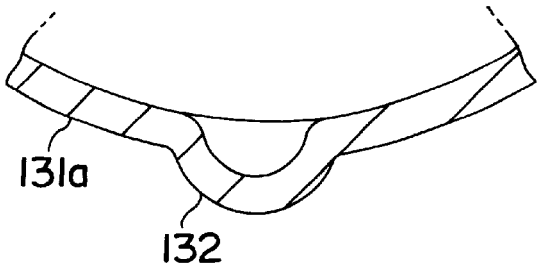
FIG. 17 is an enlarged section of a protuberance of the female terminal fitting according to the tenth embodiment.

Specifically, as shown in FIGS. 15 and 16, one or more protuberances 132 are formed in specified positions (e.g. three, in particular equally circumferentially spaced positions) of the outer surface of a guiding cylindrical portion 131*a* of a guide portion 131 formed between a barrel portion 134 and a connection portion 135. The protuberances 132 are embossed before the guide portion 131 is formed into a cylindrical shape. A projecting distance of the protuberances 132 is set such that the outer diameter of the guiding cylindrical portion 131*a* where the protuberances 132 are formed is slightly smaller than the inner diameter of the receptacle 115 (see FIG. 11). Since the other construction is similar to or the same as that of the eighth embodiment, no description is given by identifying the corresponding or same elements by the same reference numerals. In order to ensure a smooth guiding function, it is preferred that three or more protuberances 132 be circumferentially arranged at specified intervals. However, the arrangement of one or two protuberances and the unequal arrangement of the protuberances are also embraced by the present invention. The protuberances may be displaced (not shown) with respect to each other in the longitudinal direction of the guide portion.

Thus, when a female terminal fitting 133 is obliquely inserted while being displaced from its proper insertion position, a guide surface 131*b* and the protuberances 132 come into contact with the opening edge 115*a* of the receptacle 115, thereby guiding the fitting 133 to the proper insertion position. Accordingly, the fittings 175, 111 (see FIG. 11) can be easily and securely connected in this embodiment as well. Further, similar to the ninth embodiment, since the female terminal fitting 133 can be guided over a wider range by forming the protuberances 132 on the guiding cylindrical portion 131*a*, it can be effectively guided to its proper insertion position even if the diameter of the guide portion 131 is smaller than the inner diameter of the receptacle 115.

Figure 18:
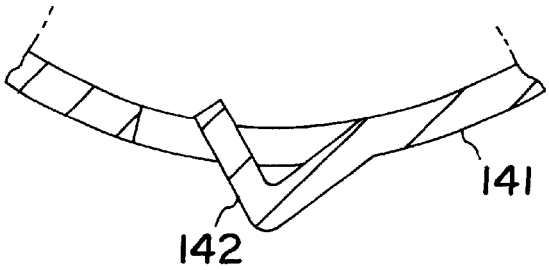
FIG. 18 is an enlarged section of another protuberance of the female terminal fitting according to the tenth embodiment.

The protuberances 132 may not necessarily be formed by embossing. As shown in FIG. 18, a protuberance 142 may be formed by making a U-shaped cut in a specified position of the outer surface of a guiding cylindrical portion 141 along the circumferential direction and then bending the cut portion such that a substantially triangular projection bulges outward.

Figure 19:
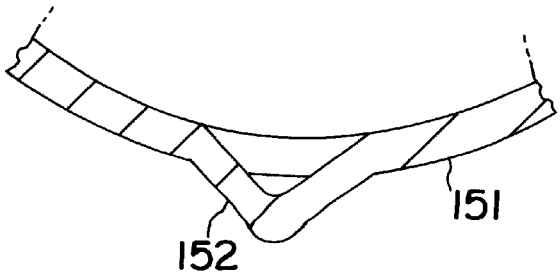
FIG. 19 is an enlarged section of still another protuberance of the female terminal fitting according to the tenth embodiment.

Further as shown in FIG. 19, a protuberance 152 may be formed by making two parallel cuts in a specified position of the outer surface of a guiding cylindrical portion 151 and then embossing the cut portion such that a substantially triangular projection bulges outward.

An eleventh embodiment of the wire end connection construction according to the invention is described with reference to FIG. 20.

The eleventh embodiment differs from the eighth embodiment in that a base portion of the female terminal fitting held by the retaining portion 126 is exposed in the eighth embodiment, but is covered by a covering portion 65 in the eleventh embodiment.

Figure 20:
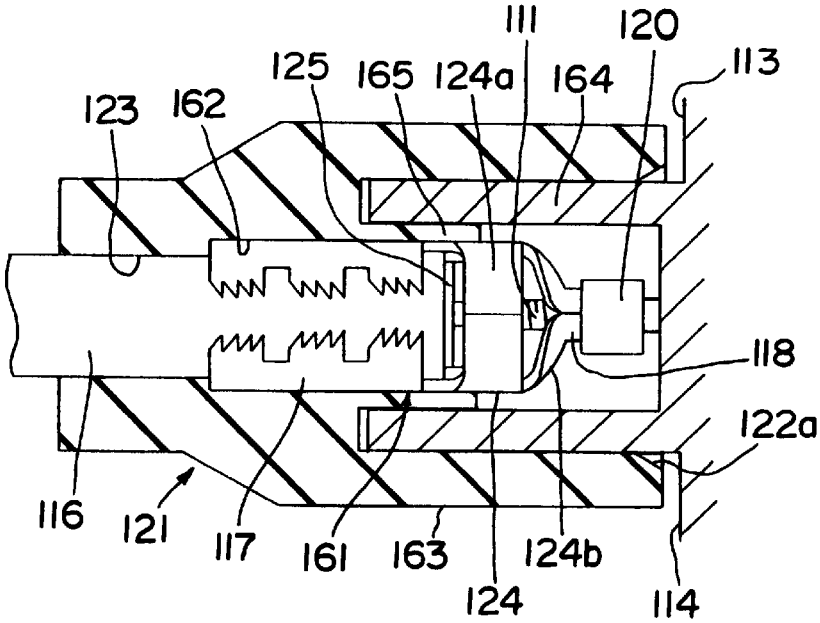
FIG. 20 is a section of an eleventh embodiment.

Specifically, as shown in FIG. 20, the opening edge of a retaining portion 162 for retaining a female terminal fitting 161 extends into a sealing tubular portion 163, thereby forming a covering portion 165. A base portion of the fitting 161 is covered by the covering portion 165. Thus, even if a vehicle vibrates, the fitting 161 is not brought into contact with the inner wall surface of a receptacle 164, with the result that the connection construction is allowed to have an excellent durability by preventing an abrasion of the fitting 161 and the receptacle 164. Furthermore a sealing action e.g. against infiltration of water or moisture, can be improved. Since the other construction is similar or same as that of the eighth embodiment, no description is given by identifying the corresponding or same elements by the same reference numerals.

The present invention is not limited to the foregoing embodiments, but may be embodied in the following manners. These embodiments are also embraced by the technical scope of the present invention as defined in the claims.

(1) Although the guide portions 124, 131, 173 are integrally formed with the female terminal fittings 112, 133, 161, 175 in the foregoing embodiments, a portion of the female terminal fitting between the barrel portion and the connection portion may be narrowed and a separate guide portion having a hollow cylindrical shape and a tapered leading end may be fitted on this narrowed portion.

(2) Although the barrel portion 117 includes three pairs of deformable members 119 in the foregoing embodiments, it may include one, two or more than three pairs of deformable members 119. Further, the leading end of each deformable member 119 may not be serrated.

Figure 21:
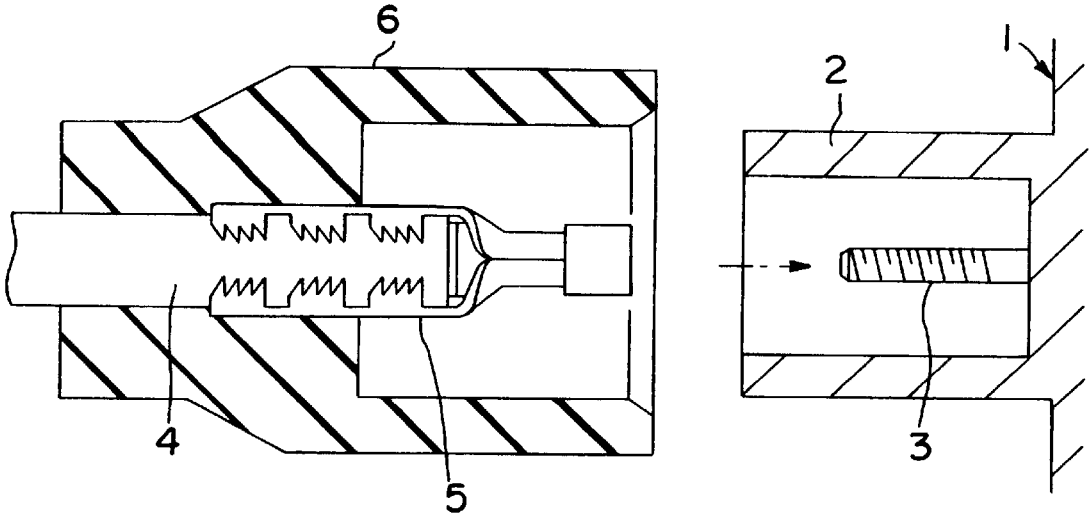
FIG. 21 PRIOR ART
FIG. 21 is a section of a prior art connection construction.

(3) Although the guide portions 124, 131, 173 are formed between the barrel portions 117, 134, 171 and the connection portions 118, 135, 172 in the foregoing embodiments, the barrel portion and the connection may abut against each other (see FIG. 21), and the guide portion may be formed such that its front portion projects outward at the leading end of the connection portion and has an outer surface which gradually widens toward the backward, and its remaining portion covers the connection portion and a part of the barrel portion.

A variety of other changes are possible without departing the scope and spirit of the present invention as defined in the claims.

LIST OF REFERENCE NUMERALS

11, 35 . . . Male Terminal Fitting (Other Terminal Fitting)
12, 34 . . . Female Terminal Fitting (One Terminal Fitting)
13 . . . Distributor (Equipment)
15, 32 . . . Receptacle (Terminal Chamber or Tubular Wall)
16 . . . Wire
21 . . . Seal Member
22, 61 . . . Sealing Tubular Portion (Outer Sealing Portion)
24, 31, 41, 51, 71, 81 . . . Guide Portion
26 . . . Retaining Portion
33, 72, 82 . . . Projected Portion (Inner Sealing Portion)
42 . . . Bulging Portion (Inner Sealing Portion)
52 . . . Lip (Inner Sealing Portion)
73, 83 . . . Clearance
111 . . . Male Terminal Fitting (Other Terminal Fitting)
115, 164 . . . Receptacle (Terminal Chamber)
116 . . . Wire
117, 134, 171 . . . Barrel Portion (Securing Portion)
118, 135, 171 . . . Connection Portion
121 . . . Seal Member
124, 131, 173 . . . Guide Portion
132, 142, 152 . . . Protuberance

What is claimed is:

1. A wire end connection construction comprising:

an equipment terminal fitting disposed on an equipment and having a free end;

a substantially cylindrical terminal chamber wall projecting from the equipment and surrounding the equipment terminal fitting, said cylindrical terminal chamber wall having an inside diameter substantially greater than the equipment terminal fitting such that said cylindrical terminal chamber wall is spaced outwardly from said equipment terminal fitting, said substantially cylindrical terminal chamber wall further having an end projecting beyond said equipment terminal fitting by a selected equipment terminal recess distance;

a wire terminal fitting unitarily formed from a conductive metal and having opposed first and second longitudinal ends, the first longitudinal end of the wire terminal fitting defining a substantially cylindrical barrel securely connected to a wire, the barrel having an outside diameter less than the inside diameter of the cylindrical terminal chamber wall, the second end of the wire terminal fitting being formed into a substantially tubular connection portion dimensioned for electrical connection over the equipment terminal fitting, and a tapering guide portion having a small diameter in proximity to the connection portion and a large diameter adjacent the barrel, the large diameter of the tapering guide portion being substantially equal to the outside diameter of the cylindrical barrel, said guide portion being spaced from the second end of the wire terminal fitting by a distance less than the equipment terminal recess distance;

a seal member sealably surrounding and engaging portions of the barrel adjacent the first end of said wire terminal fitting and portions of the wire connected with the wire terminal fitting such that the connector portion, the guide portion and portions of the cylindrical barrel of said wire terminal fitting are exposed and project beyond the seal member by a projecting distance approximately equal to the projection of the cylindrical terminal chamber wall from the equipment; and a cylindrical sealing tubular portion projecting unitarily from said seal member a distance greater than the projection of the wire terminal fitting from the seal member, said sealing tubular portion having an inner cylindrical surface defining an internal diameter selected for sealing engagement around said terminal chamber wall;

whereby the substantially cylindrical terminal chamber wall is slidable along the tapering guide portion and the cylindrical barrel of the wire terminal fitting for guiding the tubular connection portion of the wire terminal fitting toward the equipment terminal fitting and into mating engagement therewith.

* * * * *